US008478148B2

(12) United States Patent
Nakatsuhara et al.

(10) Patent No.: US 8,478,148 B2
(45) Date of Patent: Jul. 2, 2013

(54) FIXING UNIT AND IMAGE FORMING APPARATUS

(75) Inventors: Masaya Nakatsuhara, Kanagawa (JP); Sho Watanabe, Kanagawa (JP); Yuichi Fukuda, Kanagawa (JP); Chikara Ando, Kanagawa (JP); Toshiyuki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 250 days.

(21) Appl. No.: 13/022,203

(22) Filed: Feb. 7, 2011

(65) Prior Publication Data

US 2012/0070204 A1 Mar. 22, 2012

(30) Foreign Application Priority Data

Sep. 16, 2010 (JP) ..... 2010-207896

(51) Int. Cl.
*G03G 15/00* (2006.01)
*G03G 15/20* (2006.01)

(52) U.S. Cl.
USPC ..... 399/45; 399/323

(58) Field of Classification Search
USPC ..... 399/45, 67, 322, 323
See application file for complete search history.

(56) References Cited

U.S. PATENT DOCUMENTS 7,418,229 B2 * 8/2008 Aruga et al. ..... 399/329
2002/0025204 A1 2/2002 Ando et al.

FOREIGN PATENT DOCUMENTS

JP A-2002-145503 5/2002
JP A-2005-234103 9/2005
JP A-2007-114634 5/2007
JP A-2007-121407 5/2007

* cited by examiner

*Primary Examiner* — David Gray
*Assistant Examiner* — Erika J Villaluna
(74) *Attorney, Agent, or Firm* — Oliff & Berridge, PLC

(57) ABSTRACT

A fixing unit includes: a support member; an endless-belt-like fixing member which is wound on the support member; a pressure member which rotates in a fixed rotation direction while being pressed onto the fixing member; a fixing portion in which the fixing member and the pressure member abut against each other to perform fixation on a recording medium; a separation unit which is provided in a space between the support member and the fixing member on a downstream side of the fixing member in a rotation direction of the fixing member and for separating the recording medium from the fixing member; a separation portion which is provided in the separation unit to press the fixing member onto the pressure member and guide the fixing member to leave the pressure member; and an adjustment unit as defined herein.

13 Claims, 6 Drawing Sheets

FIXING UNIT AND IMAGE FORMING APPARATUS

CROSS-REFERENCE TO RELATED APPLICATIONS

This application is based on and claims priority under 35 USC 119 from Japanese Patent Application No. 2010-207896 filed on Sep. 16, 2010.

BACKGROUND

TECHNICAL FIELD

The present invention relates to a fixing unit and an image forming apparatus.

SUMMARY

According to an aspect of the invention, there is provided a fixing unit including: a support member; an endless-belt-like fixing member which is wound on the support member; a pressure member which rotates in a fixed rotation direction while being pressed onto the fixing member; a fixing portion in which the fixing member and the pressure member abut against each other to perform fixation on a recording medium; a separation unit which is provided in a space between the support member and the fixing member on a downstream side of the fixing member in a rotation direction of the fixing member and for separating the recording medium from the fixing member; a separation portion which is provided in the separation unit to press the fixing member onto the pressure member and guide the fixing member to leave the pressure member; and an adjustment unit which makes a separation position where the fixing member leaves from the pressure member, farther from the fixing portion in accordance with thickness of the recording medium, and which increases an angle between a tangent line direction of the pressure member and the fixing member in the separation position.

BRIEF DESCRIPTION OF THE DRAWINGS

Exemplary embodiments of the present invention will be described in detail based on the following figures, wherein.

DETAILED DESCRIPTION

(1) Fundamental Configuration and Operation of Image Forming Apparatus

Figure 1:
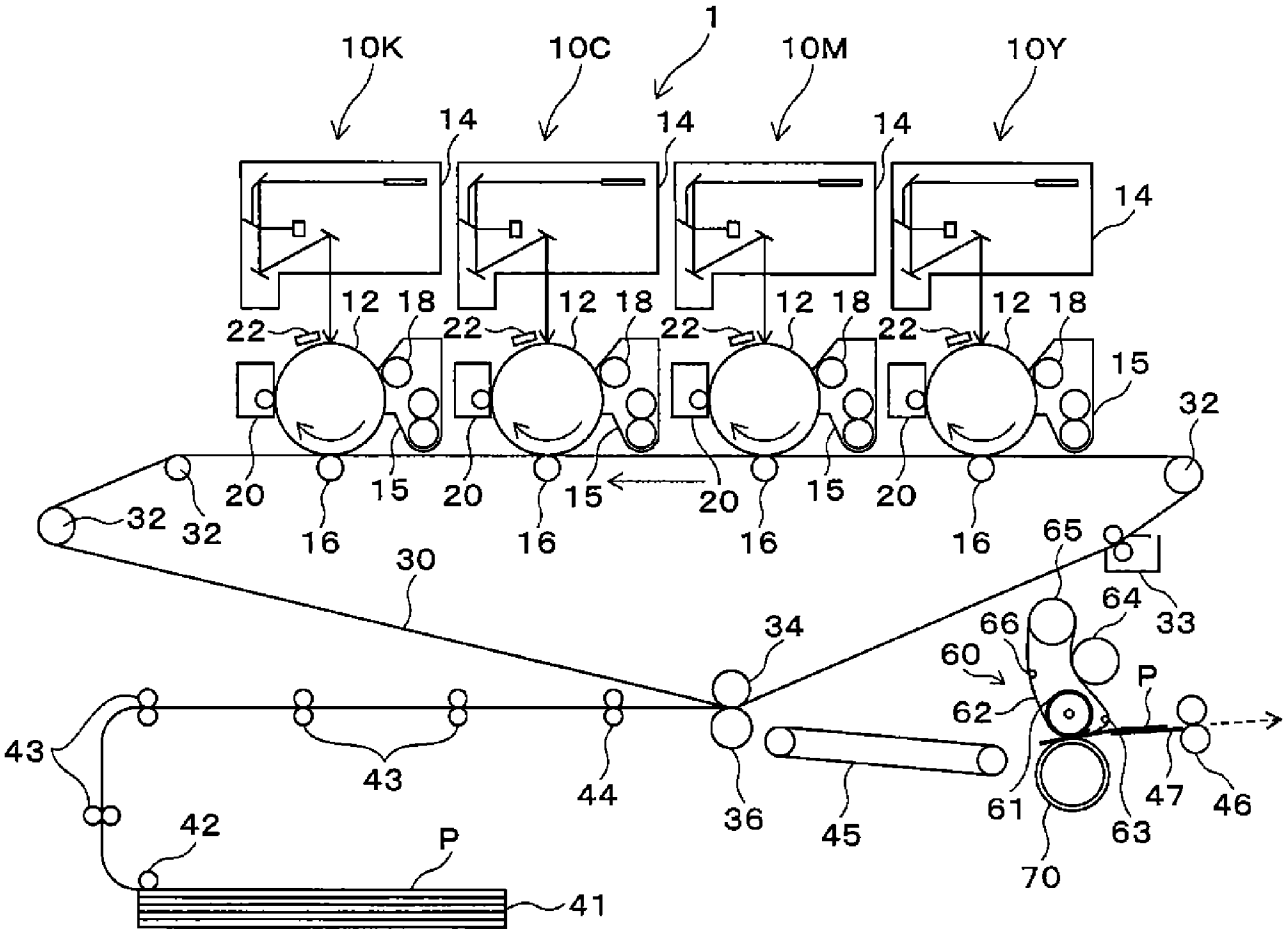
FIG. 1 is a schematic view showing the whole of an image forming apparatus according to an exemplary embodiment of the invention.

As shown in FIG. 1, this image forming apparatus 1 performs image processing based on color image information obtained by reading out a document or color image information sent from an image data input apparatus such as a personal computer, and forms a color image on a sheet P by electrophotography. The sheet P is an example of a member on which fixation is performed. Examples of recording media include resin sheets such as OHP sheets as well as paper sheets.

The image forming apparatus 1 has image forming units 10Y, 10M, 10C and 10K as examples of image forming portions for forming toner images of respective colors, i.e. yellow (Y), magenta (M), cyan (C) and black (K). The image forming units 10Y, 10M, 10C and 10K are arrayed in series in the named order with respect to a traveling direction of an endless intermediate transfer belt 30 stretched among a backup roll 34 and a plurality of rolls 32. In addition, the intermediate transfer belt 30 passes between a photoconductor drum 12 as an image retainer constituting each image forming unit 10Y, 10M, 10C, 10K and a primary transfer roll 16 disposed oppositely to the photoconductor drum 12, and between the backup roll 34 and a secondary transfer roll 36 as an image transfer portion in contact with the backup roll 34.

Further, a charger 22, an exposure unit 14, a development unit 15 and a photoconductor cleaner 20 are provided around each photoconductor drum 12. The charger 22 charges the surface of the photoconductor drum 12 uniformly. The exposure unit 14 serves as an exposure unit which irradiates the surface of the photoconductor drum 12 with light to form an electrostatic latent image on the surface of the photoconductor drum 12. The development unit 15 visualizes the electrostatic latent image with toner to form a toner image. The photoconductor cleaner 20 removes transfer residual toner or the like from the surface of the photoconductor drum 12.

A sheet feed unit 41 is disposed in a lower portion of the image forming apparatus 1. A pickup roll 42 for picking up the uppermost one of stacked sheets P is disposed above a left end portion of the sheet feed unit 41. On a left side of the pickup roll 42, a conveyance path is bent upward by a guide or the like. Paired conveyance rolls 43 are disposed on a downstream side of the upward bent portion of the conveyance path. The conveyance path is further bent right by a guide or the like, and paired conveyance rolls 43 are disposed on a downstream side of the right bent portion of the conveyance path. Paired registration rolls 44 are disposed on a downstream side of the paired conveyance rolls 43. The aforementioned pair of the backup roll 34 and the secondary transfer roll 36 are disposed on a downstream side of the paired registration rolls 44. On the right side of the pair of the backup roll 34 and the secondary transfer roll 36, a fixing unit 60 is disposed with a conveyance belt 45 put therebetween. Paired output rolls 46 and an output guide 47 are disposed on a downstream side of the fixing unit 60. The configuration of the fixing unit 60 will be described in detail later.

Next, the operation of image formation performed by the image forming unit 10Y for forming a yellow toner image will be described representatively.

The surface of the photoconductor drum 12 provided in the image forming unit 10Y is charged uniformly by the charger 22. Further, the exposure unit 14 emits a light beam onto the photoconductor drum 12 based on image data to perform exposure corresponding to a yellow image. Thus, an electrostatic latent image corresponding to the yellow image is formed on the surface of the photoconductor drum 12.

The electrostatic latent image corresponding to the yellow image on the photoconductor drum 12 is developed with toner retained on a developing roll 18 of the development unit 15 so as to be formed as a yellow toner image. The yellow toner image is primarily transferred onto the intermediate transfer belt 30 by the pressure of the primary transfer roll 16 and an electrostatic attraction force of transfer bias applied to the primary transfer roll 16.

In this primary transfer, the yellow toner image is not wholly transferred onto the intermediate transfer belt 30 but partially remains on the photoconductor drum 12. In addition, an external additive to the toner or the like also adheres to the surface of the photoconductor drum 12. The photoconductor drum 12 after the primary transfer is passed through a position opposed to the photoconductor cleaner 20, so that transfer residual toner etc. on the photoconductor drum 12 is removed. After that, the surface of the photoconductor drum 12 is charged again by the charger 22 for the next image formation cycle.

In addition, in the image forming apparatus 1, an image forming process the same as the aforementioned image forming process is performed in the respective color image forming units 10Y, 10M, 10C and 10K at timings in which a relative position gap between adjacent ones of the image forming units 10Y, 10M, 10C and 10K has been taken into consideration. Thus, toner images of the respective colors Y, M, C and K are superposed sequentially on the intermediate transfer belt 30 so as to form multiple toner images on the intermediate transfer belt 30.

Then, by the electrostatic attraction force of the secondary transfer roll 36 to which transfer bias is applied, the multiple toner images are collectively transferred from the intermediate transfer belt 30 to the sheet P which is, for example, conveyed from the sheet feed unit 41 through the pickup roll 42 and the paired conveyance rolls 43 to the secondary transfer roll 36 at a conveyance timing determined by the registration rolls 44. Toner etc. which has not been transferred to the sheet P but remains on the intermediate transfer belt 30 is recovered by a belt cleaner 33.

Further, the sheet P to which the multiple toner images have been transferred from the intermediate transfer belt 30 is conveyed to the fixing unit 60 by which the multiple toner images are fixed to the sheet P by heat and pressure. Thus, a full color image is formed on the sheet P. After that, the sheet P is outputted through the output guide 47 and the paired output rolls 46.

(2) Configuration of Fixing Unit

Next, the configuration of the fixing unit 60 will be described with reference to FIG. 2 et seq. In these drawings, the reference numeral 61 represents a fixing roll as an example of a support member. The fixing roll 61 is a cylindrical roll formed out of aluminum or the like, and a halogen lamp 61*a* is provided inside the fixing roll 61 to extend all over the length of the fixing roll 61. The fixing roll 61 is rotated counterclockwise in FIG. 2 by a not-shown drive mechanism.

A fixing belt 62 as an example of a fixing member is wound on the fixing roll 61. The fixing belt 62 is wound on tension rolls 63, 64, 65 and 66 so that a constant tension is applied to the fixing belt 62 by the tension rolls 63, 64, 65 and 66. These tension rolls 63 and so on are formed out of aluminum or the like, and halogen lamps 64*a* and 65*a* each having a function equivalent to that of the halogen lamp 61*a* are provided inside the tension rolls 64 and 65 respectively.

The fixing belt 62 is an endless belt, which is constituted by a multilayer structure consisting of a base layer, a silicone rubber layer and a release layer. The base layer is formed out of polyimide resin or the like. The silicone rubber layer is laminated on a surface side (outer circumferential surface side) of the base layer. The release layer made from tetrafluoroethylene-perfluoroalkyl vinyl ether copolymer resin (PFA) or the like is further formed on the silicone rubber layer.

A pressure roll 70 as an example of a pressure member is brought into pressure contact with the fixing roll 61 on which the fixing belt 62 is wound. In the pressure roll 70, a silicone rubber layer 72 is formed on the outer circumference of a cylindrical core 71 formed out of aluminum or the like, and a release layer 73 made from PFA is provided on the outer circumference of the silicone rubber layer 72. The silicone rubber layer 72 pressed by the fixing roller 61 is elastically deformed to form a roll nip portion A as a fixing portion between the fixing roll 61 and the pressure roll 70. The pressure roll 70 is rotated clockwise in FIG. 2 with the movement of the fixing belt 62. When the sheet P is put between the fixing belt 62 and the pressure roll 70, the multiple toner images are fixed to the sheet P by heat and pressure of the fixing belt 62 so that a full color image is formed on the sheet P. In the following description, "rotation direction" will mean the rotation direction of the pressure roll 70.

Figure 3:
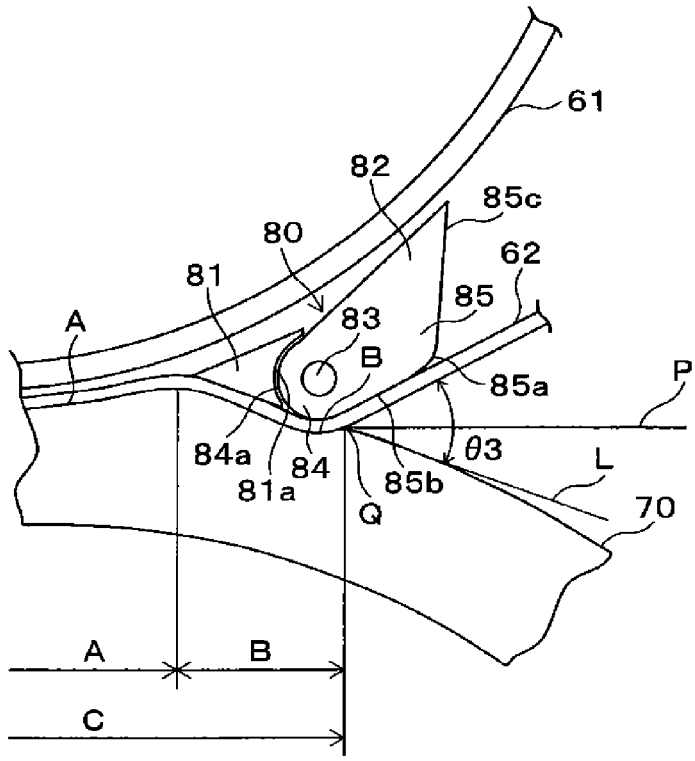
FIG. 3 is a sectional view showing a main part of the fixing unit according to the exemplary embodiment of the invention.

As shown in FIG. 3, a separation unit 80 is provided in an exit of the roll nip portion A so as to extend all over the length thereof intersecting the moving direction of the fixing belt 62. The separation unit 80 has a wedge member 81 whose front end is brought close to the roll nip portion A. The wedge member 81 is fixed to a not-shown body of the fixing unit 60. The wedge member 81 pushes the fixing belt 62, which is stretched between the roll nip portion A and the tension roll 63, toward the pressure roll 70 so as to press the fixing belt 62 onto the pressure roll 70. A concave curved surface 81*a* having an arc shape in side view from the rotation axis direction of the pressure roll 70 is formed in a rotation-direction-side end surface of the wedge member 81.

A separation pad 82 as an example of a separation portion is disposed on the rotation direction side of the wedge member 81. The separation pad 82 has a support portion 84 which is rotatably supported by a shaft 83 as an example of an adjustment unit, and a pressing portion 85 whose vertical thickness increases gradually with increase of its distance from the support portion 84. An end surface of the support portion 84 is formed into a semicircular convex curved surface 84*a*. The convex curved surface 84*a* is fitted to the concave curved surface 81*a* of the wedge member 81. In addition, the shaft 83 is rotated by a not-shown drive mechanism so that the pressing portion 85 can rotate clockwise and counterclockwise in FIG. 3.

Figure 6:
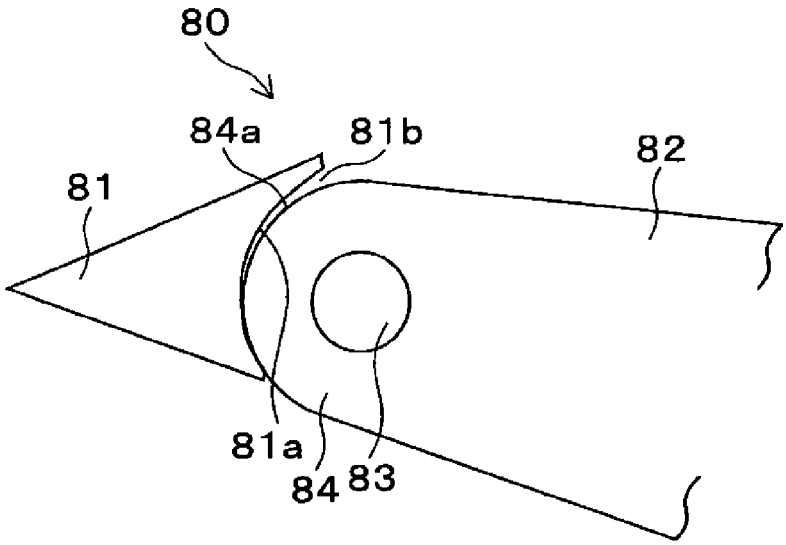
FIG. 6 is a sectional view showing a part of the fixing unit according to the exemplary embodiment of the invention.

In the pressing portion 85, a convex curved surface 85*a* having an arc shape in side view is formed in the portion where a pressing surface 85*b* intersects an end surface 85*c* which is on the opposite side to the support portion 84. The curvature of the convex curved surface 85*a* is set to be larger than the curvature of the convex curved surface 84*a* of the support portion 84. As shown in FIG. 6, a gap 81*b* is provided between the convex curved surface 84*a* and the concave curved surface 81*a* of the wedge member 81. The gap 81*b* is expanded at the top and narrowed gradually toward the bottom.

As shown in FIG. 3, between the fixing belt 62 and the pressure roll 70, a roll nip portion A having a length A is formed by the fixing roll 61 pressing the fixing belt 62 onto the pressure roll 70, and a pad nip portion B having a length B is formed by the wedge member 81 and the support portion 84 of the separation unit 80 pressing the fixing belt 62 onto the pressure roll 70. Thus, fixation is performed on the sheet P in a total nip portion having a total length C. In the state shown in FIG. 3, the pad nip portion B has a minimum length. When the separation pad 82 is rotated clockwise in that state, the length of the pad nip portion B increases.

(3) Operation of Fixing Unit

Figure 2:
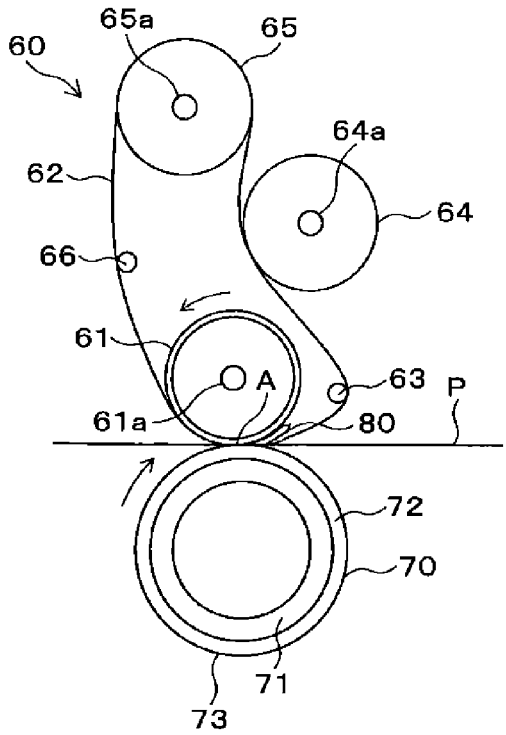
FIG. 2 is a schematic view showing the whole of a fixing unit according to the exemplary embodiment of the invention.
Figure 4:
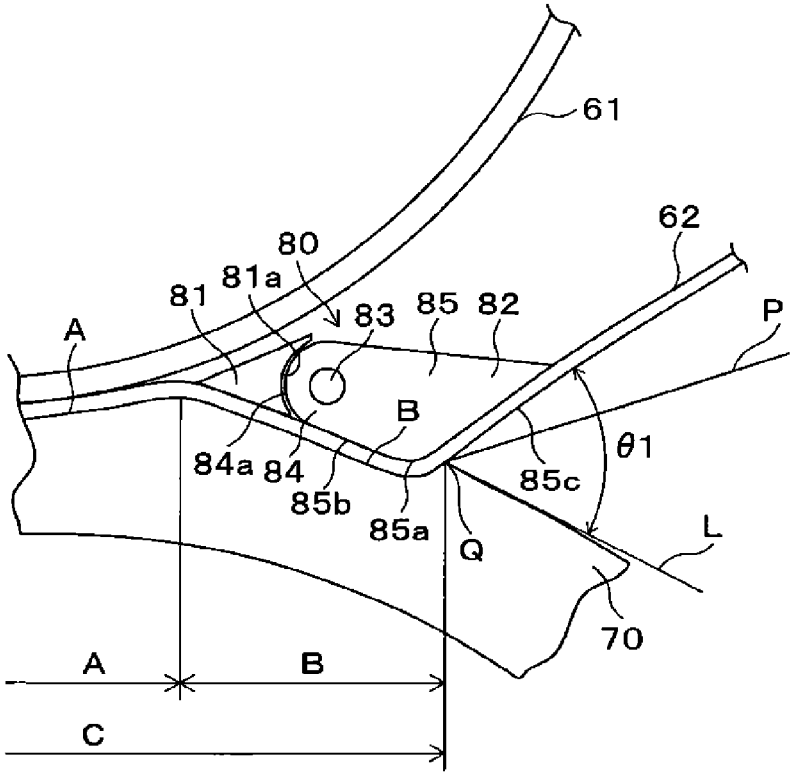
FIG. 4 is a sectional view showing the main part of the fixing unit according to the exemplary embodiment of the invention.

The sheet P to which the multiple toner images have been secondarily transferred enters the roll nip portion A and the pad nip portion B between the fixing belt 62 and the pressure roll 70 from the left side in FIG. 2. The multiple toner images are fixed to the sheet P by the heat and pressure of the fixing belt 62 so that a full color image is formed on the sheet P. Here, in this exemplary embodiment, the position of the separation pad 82 is changed in accordance with the thickness of the sheet P. In FIG. 4, fixation is performed on a sheet P which is thin paper having a basis weight smaller than 80 gsm. The separation pad 82 is rotated clockwise to the greatest extent possible. Thus, the fixing belt 62 is pressed onto the pressure roll 70 by the whole of the pressing surface 85*b* of the pressing portion 85. In this case, the length of the pad nip portion B is the longest.

Figure 5:
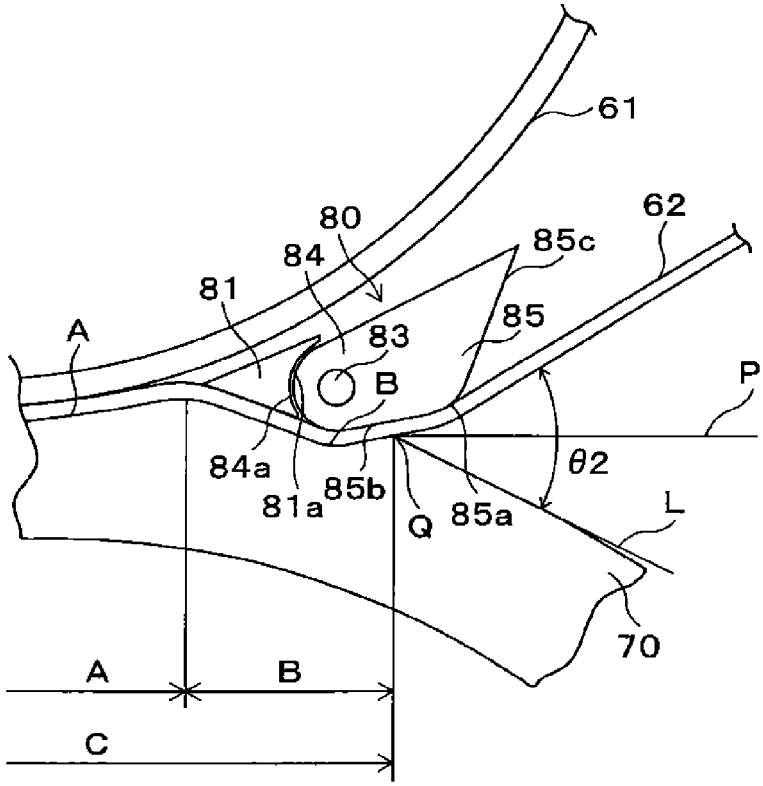
FIG. 5 is a sectional view showing the main part of the fixing unit according to the exemplary embodiment of the invention.

FIG. 3 shows the state where fixation is performed on a sheet P of thick paper beyond a basis weight of 200 gsm. The separation pad 82 is rotated counterclockwise. Thus, of the separation pad 82, only the support portion 84 presses the fixing belt 62 onto the pressure roll 70. In this case, the length of the pad nip portion B is the shortest as described above. In FIG. 5, fixation is performed on a sheet P called regular paper having a basis weight of 80 gsm to 127 gsm, and a sheet P having a middle basis weight which is larger than 127 gsm but not larger than 200 gsm. The separation pad 82 is located in an intermediate state between the state shown in FIG. 3 and the state shown in FIG. 4. In addition, in this case, the length of the pad nip portion B is an average length of the lengths shown in FIGS. 3 and 4. The length of the pad nip portion B may be set bit by bit in accordance with the thickness of the sheet P. The operation of fixation on the sheet P will be described sequentially in order from the case where the sheet P is thin paper.

In the state shown in FIG. 4, the fixing belt 62 rises from the convex curved surface 85*a* of the separation pad 82 and leaves the pressure roll 70 to move toward the tension roll 63. A tangent line L is drawn from a separation point Q where the fixing belt 62 leaves the pressure roll 70 to the outer circumferential surface of the pressure roll 70. In this case, if an angle θ1 between the tangent line L and the fixing belt 62 is large, the sheet P cannot follow the sudden change of the traveling direction of the fixing belt 62, but will be separated from the fixing belt 62 by the elasticity of the sheet P. The angle θ1 is set by the angle between the pressing surface 85*b* and the end surface 85*c* of the separation pad 82.

On the other hand, even if the angle θ1 is large, the sheet P can move together with the fixing belt 62 without being separated from the fixing belt 62 when the convex curved surface 85*a* with which the fixing belt 62 should be bent in friction has a small curvature. Accordingly, the angle θ1 and the curvature of the convex curved surface 85*a* obtained experimentally are set so that a thinnest sheet P which may be possibly used can be separated from the fixing belt 62.

In the state shown in FIG. 4, the length of the pad nip portion B is the largest. The temperature of the fixing belt is lowered for a sheet P of thin paper having a small heat capacity. Thus, the sheet P can be prevented from expanding due to vapor coming from moisture contained in the sheet P. When the top end of the sheet P reaches the convex curved surface 85*a* of the separation pad 82, the traveling direction of the fixing belt 62 is changed to the angle θ1 due to the curvature of the convex curved surface 85*a*. Thus, the sheet P is separated from the fixing belt 62.

In addition, in this exemplary embodiment, the upper surface of the fixing belt 62 is pressed by the wedge member 81 and the separation pad 82 in the pad nip portion B. As a result, the sheet P can be prevented from expanding due to vapor coming from the moisture contained in the sheet P, and occurrence of an image defect due to the vapor blowing out from the upper surface of the sheet P can be prevented. Particularly in this exemplary embodiment, the gap 81*b* between the convex curved surface 84*a* of the support portion 84 and the concave curved surface 81*a* of the wedge member 81 in the separation pad 82 is formed to be expanded at the top and narrowed gradually toward the bottom. Thus, the change in fixing pressure between the convex curved surface 84*a* and the concave curved surface 81*a* can be reduced so as to suppress the expansion caused by the vapor.

Next, description will be made on the operation in the case where fixation is performed on a sheet P of regular paper or middle-basis-weight paper. FIG. 5 shows the state where the separation pad 82 has been rotated counterclockwise in the state shown in FIG. 4. The length of the pad nip portion B in FIG. 5 is shorter than that in the case shown in FIG. 4. In addition, when a tangent line L is drawn from the separation point Q where the fixing belt 62 leaves the pressure roll 70 to the outer circumferential surface of the pressure roll 70, an angle θ2 between the tangent line L and the fixing belt 62 is smaller than the angle θ1 shown in FIG. 4. Further, the traveling direction of the fixing belt 62 is changed in the convex curved surface 84*a* of the support portion 84 in the separation pad 82. The curvature of the convex curved surface 84*a* is smaller than the curvature of the convex curved surface 85*a*. Therefore, when fixation is performed on a sheet P of regular paper or middle-basis-weight paper shown in FIG. 5, the operation of separating the sheet P from the fixing belt 62 is not as conspicuous as that when fixation is performed on a sheet P of thin paper shown in FIG. 4.

However, the sheet P of regular paper or middle-basis-weight paper has enough elasticity. Thus, the sheet P can be separated from the fixing belt 62 in spite of the angle θ2 and the curvature of the convex curved surface 84*a* as shown in FIG. 5. That is, as soon as the top end of the sheet P reaches the convex curved surface 84*a* of the support portion 84 in the separation pad 82, the traveling direction of the fixing belt 62 is changed to the angle θ2 due to the curvature of the convex curved surface 84*a* so that the sheet P is separated from the fixing belt 62. In addition, when excessive pressure and heat are applied to the sheet P of regular paper or middle-basis-weight paper, melting of toner may be uneven or a granular pattern may appear in an image . With respect to this point, in this exemplary embodiment, the length of the pad nip portion B is made shorter than that in the case where fixation is performed on the sheet P of thin paper shown in FIG. 4, so that occurrence of the aforementioned image defect can be suppressed. Since the applied pressure and heat can be suppressed, there is another effect that the level of gloss can be suppressed in the image. Further, the traveling direction of the fixing belt 62 is not changed with a large curvature as in the fixation on the sheet P of thin paper shown in FIG. 4. Accordingly, a shearing force acting on the sheet P is smaller than that in the case shown in FIG. 4. It is therefore possible to suppress occurrence of such a problem that the level of gloss differs from one place to another in the image.

Next, description will be made on the operation in the case where fixation is performed on a sheet P of thick paper. FIG. 3 shows the state where the separation pad 82 has been further rotated counterclockwise in the state shown in FIG. 5. The length of the pad nip portion B in FIG. 3 is shorter than that in the case shown in FIG. 5. In addition, when a tangent line L is drawn from the separation point Q where the fixing belt 62 leaves the pressure roll 70 to the outer circumferential surface of the pressure roll 70, an angle θ3 between the tangent line L and the fixing belt 62 is smaller than the angle θ1 shown in FIG. 4. Further, the traveling direction of the fixing belt 62 is changed in the convex curved surface 84*a* of the support portion 84 in the separation pad 82 in the same manner as in the case of the sheet P of regular paper or middle-basis-weight paper shown in FIG. 5.

As soon as the top end of the sheet P reaches the convex curved surface 84*a* of the support portion 84 in the separation pad 82, the traveling direction of the fixing belt 62 is changed to the angle θ3 due to the curvature of the convex curved surface 84*a*. Thus, the sheet P of hard thick paper is separated from the fixing belt 62. In addition, when excessive pressure and heat are applied to the sheet P of thick paper, the phenomenon that melting of toner is uneven or a granular pattern appears in an image may occur more easily than the case of the sheet P of regular paper or middle-basis-weight paper. With respect to this point, in this exemplary embodiment, the length of the pad nip portion B is made shorter than that in the case where fixation is performed on the sheet P of regular paper or middle-basis-weight paper shown in FIG. 5, so that occurrence of the aforementioned image defect can be suppressed. Since the applied pressure and heat can be suppressed, it is therefore possible to suppress the level of gloss in the image while suppressing occurrence of such a problem that the level of gloss differs from one place to another in the image.

In the fixing unit configured thus, the angle and the curvature based on which the fixing belt 62 changes its traveling direction become maximum when the length of the pad nip portion B is the largest. Thus, it is possible to separate the sheet P of thin paper from the fixing belt 62. On the other hand, when the length of the pad nip portion B is shorter than that in the case where fixation is performed on a sheet P of thin paper, the angle and the curvature based on which the fixing belt 62 changes its traveling direction are also smaller that those in the case where fixation is performed on the sheet P of thin paper. Thus, occurrence of such an image defect that melting of toner is uneven or a granular pattern appears in an image can be suppressed to improve the characteristic of the image.

(4) Another Exemplary Embodiment

Figure 7:
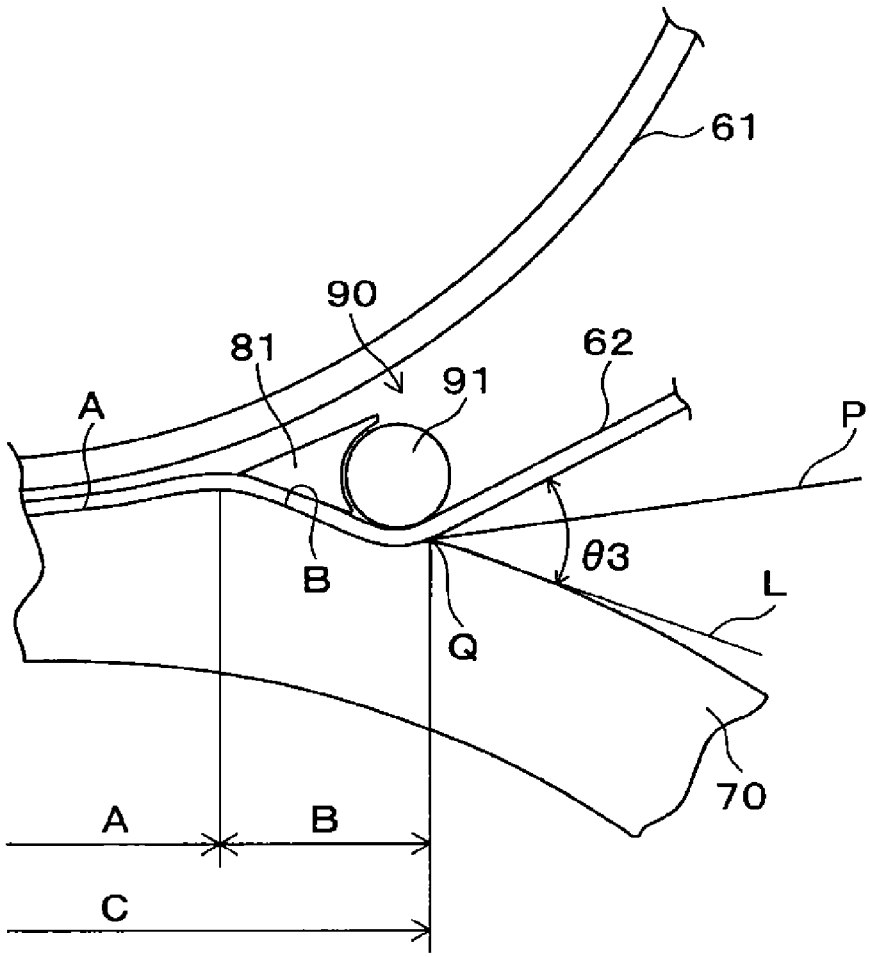
FIG. 7 is a sectional view showing a main part of a fixing unit according to another exemplary embodiment of the invention.
Figure 8:
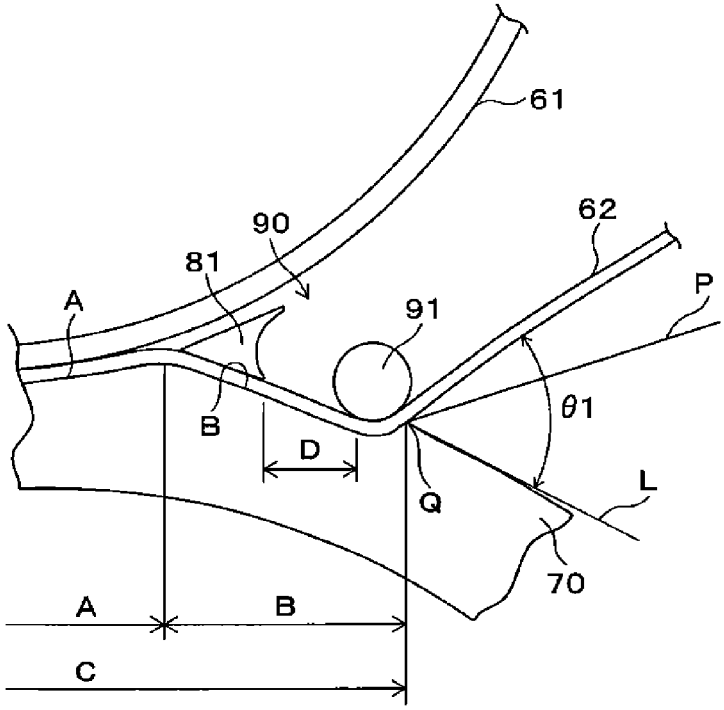
FIG. 8 is a sectional view showing the main part of the fixing unit according to the other exemplary embodiment of the invention.
Figure 9:
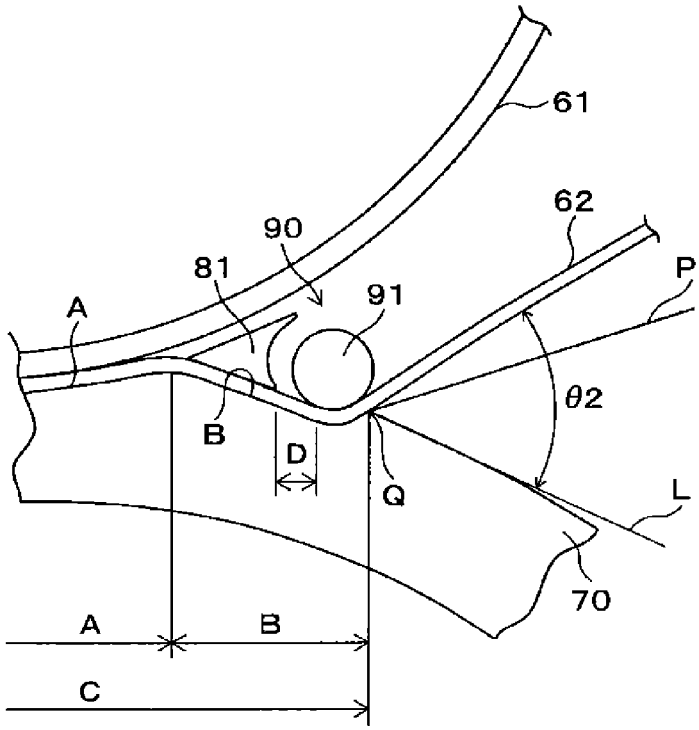
FIG. 9 is a sectional view showing the main part of the fixing unit according to the other exemplary embodiment of the invention.

Next, another exemplary embodiment of the invention will be described with reference to FIGS. 7 to 9. In the following description, constituent members equivalent to those in the aforementioned exemplary embodiment are referred to by the same numerals, and description thereof will be omitted. As shown in FIGS. 7 to 9, a shaft 91 as an example of a separation portion is provided adjacently to the wedge member 81. The shaft 91 is pressed onto the pressure roll 70 through the fixing belt 62 by a spring while being allowed to move in the rotation direction of the pressure roll 70 and in the opposite direction thereto by a not-shown drive unit (adjustment unit).

As shown in FIGS. 7 to 9, the wedge member 81 and the shaft 91 form a pad nip portion B. FIG. 8 shows a state where fixation is performed on a sheet P of thin paper. In FIG. 8, the shaft 91 is located in the rotation-direction-side end portion of the pressure roll 70. On this occasion, a portion D which is not backed up appears in the pad nip portion B. In FIG. 8, the fixing belt 62 rises from the outer circumferential surface of the shaft 91 and leaves the pressure roll 70 to move toward the tension roll 63 (see FIG. 2). When a tangent line L is drawn from a separation point Q where the fixing belt 62 leaves the pressure roll 70 to the outer circumferential surface of the pressure roll 70, due to the effect of an angle θ1 between the tangent line L and the fixing belt 62 and the curvature of the outer circumferential surface of the shaft 91, the sheet P cannot follow the sudden change of the traveling direction of the fixing belt 62, but will be separated from the fixing belt 62 by the hardness of the sheet P.

FIG. 9 shows a state where fixation is performed on a sheet P of regular paper or middle-basis-weight paper. In FIG. 9, the shaft 91 is closer to the wedge member 81 than that in the state shown in FIG. 8. Also in this case, a portion D which is not backed up appears in the pad nip portion B. The shaft 91 pushes the fixing belt 62 stretched between the roll nip portion A and the tension roll 63, toward the pressure roll 70. Accordingly, when the shaft 91 is brought closer to the wedge member 81, an angle θ2 between the tangent line L of the outer circumferential surface of the pressure roll 70 and the fixing belt 62 is smaller than the angle θ1. In FIG. 9, the sheet P is separated from the fixing belt 62 due to the hardness of the sheet P in spite of the angle θ2 which is smaller than the angle θ1. In addition, the length of the pad nip portion B is shorter than that in the case where fixation is performed on the sheet P of thin paper shown in FIG. 8. Thus, pressure and heat applied to the sheet P can be suppressed to improve the characteristic of an image formed on the sheet P.

FIG. 7 shows a state where fixation is performed on a sheet P of thick paper. In FIG. 7, the shaft 91 abuts against the wedge member 81 in the state shown in FIG. 9. In this case, an angle θ3 between the tangent line L of the outer circumferential surface of the pressure roll 70 and the fixing belt 62 is smaller than the angle θ2. In FIG. 7, the sheet P is separated from the fixing belt 62 due to the hardness of the sheet P in spite of the angle θ3 which is smaller than the angle θ2. In addition, the length of the pad nip portion B is shorter than that in the case where fixation is performed on the sheet P of regular paper or middle-basis-weight paper shown in FIG. 9. Thus, pressure and heat applied to the sheet P can be suppressed to improve the characteristic of an image formed on the sheet P.

In the aforementioned exemplary embodiment, the portion D which is not backed up appears in the pad nip portion B as shown in FIGS. 8 and 9. Vapor rising can be coped with by a simple configuration in which a plate member is, for example, inserted from above to press the fixing belt 62 onto the pressure roll 70.

EXAMPLE

Figure 10:
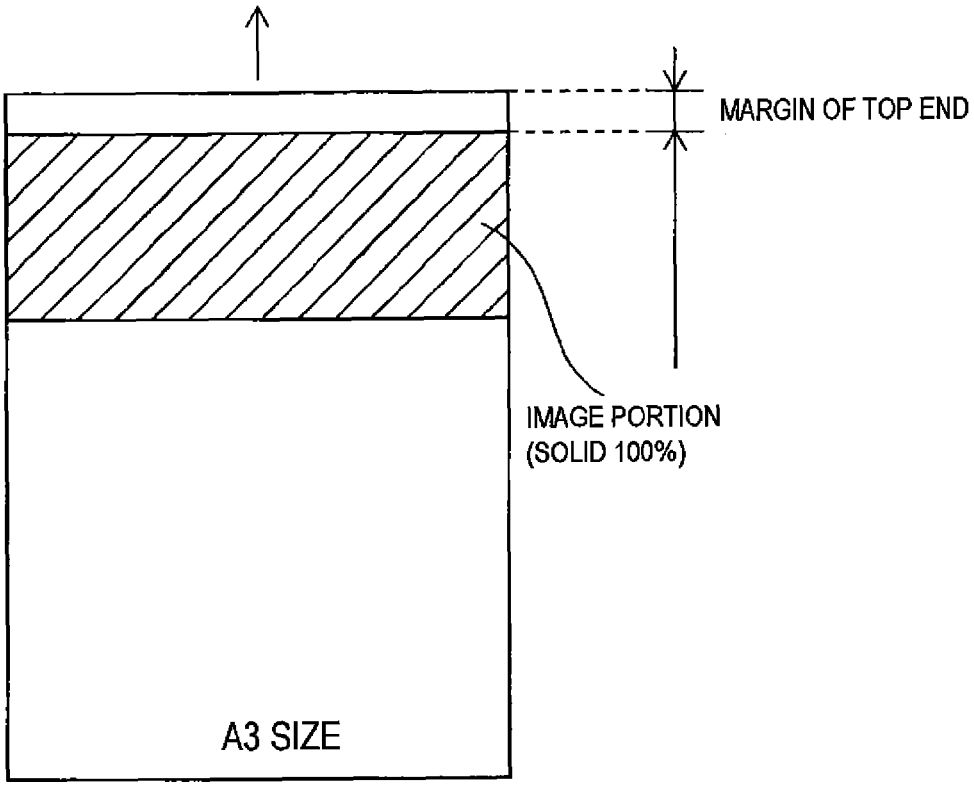
FIG. 10 is a plan view showing a sheet on which an image has been formed in Example of the invention.

Image formation shown in FIG. 10 is performed on a sheet of thin paper having a basis weight of 64 gsm. The separation state of the sheet after fixation is checked on the conditions for thick paper shown in FIG. 3 and on the conditions for thin paper shown in FIG. 4. As a result, on the conditions for thin paper, it is proved that the sheet can be separated if a margin of 0.5 mm is secured in the top end of the sheet. On the other hand, on the conditions for thick paper, it is proved that the sheet cannot be separated if the margin in the top end of the sheet is less than 4.0 mm. In the case where a sheet of paper having a middle basis weight of 127 gsm is used, it is proved that the sheet can be separated on the conditions for thin paper if a margin of 0.5 mm or less is secured in the top end of the sheet, and the sheet can be separated on the conditions for thick paper if a margin of 0.5 mm or less is secured in the top end of the sheet.

Next, the width of the pad nip portion, the angle between the tangent line drawn on the outer circumferential surface of the pressure roll and the fixing belt, and the curvature of the fixing belt are checked. The same image is formed using the aforementioned sheet of thin paper and on the conditions for thin paper. As for values required for separating the sheet on the conditions for thin paper, the width of the pad nip portion is 7 mm or more, the angle is 41° or more, and the curvature is 6.5 or more. As a result of the same image which is formed using a sheet of middle-basis-weight paper and on the conditions for thick paper, it is proved that the required width of the pad nip portion is 4 mm or less.

The fixing unit according to the invention is applicable to image forming apparatuses such as printing machines, copying machines, printers, facsimile machines, and complex machines having the same functions as those of these machines.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A fixing unit comprising:

a support member;

an endless-belt-like fixing member which is wound on the support member;

a pressure member which rotates in a fixed rotation direction while being pressed onto the fixing member;

a fixing portion in which the fixing member and the pressure member abut against each other to perform fixation on a recording medium;

a separation unit which is provided in a space between the support member and the fixing member on a downstream side of the support member in a rotation direction of the fixing member and for separating the recording medium from the fixing member;

a separation portion which is provided in the separation unit to press the fixing member onto the pressure member and guide the fixing member to leave the pressure member; and an adjustment unit which makes a separation position where the fixing member leaves the pressure member, farther from the fixing portion in accordance with a thickness of the recording medium, and which increases an angle between a tangent line direction of the pressure member and the fixing member in the separation position.

2. The fixing unit according to claim 1, wherein the separation unit comprises a wedge member whose front end is disposed to face the fixing portion and which presses the fixing member onto the pressure member.

3. The fixing unit according to claim 2, wherein the separation portion comprises a support portion which is supported rotatably around a shaft extending in a direction along a rotation axis of the pressure member on a separation portion side of the wedge member, and a pressing portion which extends from the support portion to an opposite side to the wedge member and guides the fixing member to leave the pressure member when the pressing portion is rotated toward the pressure member.

4. The fixing unit according to claim 3, wherein the support portion has a cylindrical outer circumferential surface, by which the fixing member is guided to leave the pressure member when the support portion is rotated toward the opposite side to the pressure member, and a part of the pressing portion which guides the fixing member has an arc shape and whose curvature is larger than a curvature of the support portion.

5. The fixing unit according to claim 4, wherein the pressing portion increases a rotation-direction length, with which the fixing member is pressed onto the pressure member, as the separation portion is rotated toward the pressure member.

6. The fixing unit according to claim 4, wherein an end portion of the wedge member on the separation portion side has an arc-like concave portion, and the support portion rotates along the concave portion.

7. The fixing unit according to claim 6, wherein a gap is provided between the concave portion and the support portion, and the gap is narrowed gradually toward the fixing member.

8. The fixing unit according to claim 3, wherein the pressing portion increases a rotation-direction length, with which the fixing member is pressed onto the pressure member, as the separation portion is rotated toward the pressure member.

9. The fixing unit according to claim 3, wherein an end portion of the wedge member on the separation portion side has an arc-like concave portion, and the support portion rotates along the concave portion.

10. The fixing unit according to claim 9, wherein a gap is provided between the concave portion and the support portion, and the gap is narrowed gradually toward the fixing member.

11. The fixing unit according to claim 2, wherein the separation portion is a shaft which extends in a direction along the rotation axis of the pressure member and is located on a separation portion side of the wedge member, and the shaft is movable on a downstream side along the rotation direction and on an upstream side opposite thereto.

12. An image forming apparatus comprising:

an image forming portion which forms an image on a recording medium; and the fixing unit according to claim 1, by which the image formed on the recording medium is fixed to the recording medium.

13. The fixing unit according to claim 1, wherein the adjustment unit makes the separation position where the fixing member leaves the pressure member, farther from the fixing portion in accordance with the thickness of the recording medium, and increases the angle between the tangent line direction of the pressure member and the fixing member in the separation position, by rotating the separation portion.

* * * * *